US007591039B2

(12) United States Patent
Kaleta et al.

(10) Patent No.: US 7,591,039 B2
(45) **Date of Patent: *Sep. 22, 2009**

(54) GASKETS FOR FLOOR SWEEPER

(76) Inventors: Bryan Kaleta, 1037 Hinswood Dr., Darien, IL (US) 60561; Mahesh Lakhiani, 1 Leo Ter., Denville, NJ (US) 07834

( * ) Notice: Subject to any disclaimer, the term of this patent is extended or adjusted under 35 U.S.C. 154(b) by 301 days.

This patent is subject to a terminal disclaimer.

(21) Appl. No.: 11/273,288

(22) Filed: Nov. 14, 2005

(65) Prior Publication Data

US 2007/0107149 A1 May 17, 2007

(51) Int. Cl.
*A47L 11/24* (2006.01)

(52) U.S. Cl. ..... 15/42; 15/41.1; 15/52.1; 74/606 R; 277/637

(58) Field of Classification Search ..... 15/41.1, 15/42, 48.1, 52.1; 74/606 R; 277/637, 650
See application file for complete search history.

(56) References Cited

U.S. PATENT DOCUMENTS

| | | | | | |
|---|---|---|---|---|---|
| 471,515 | A * | 3/1892 | Tangenberg | 15/42 |
| 631,837 | A * | 8/1899 | Wilkins | 15/41.1 |
| 801,882 | A * | 10/1905 | Knell | 15/42 |
| 865,084 | A * | 9/1907 | Deitch et al. | 15/42 |
| 1,607,500 | A * | 11/1926 | Agar et al. | 15/52.1 |
| 2,536,902 | A | 1/1951 | Beckett | |
| 2,707,792 | A * | 5/1955 | Waller | 15/182 |
| 2,734,211 | A * | 2/1956 | Vance | 15/183 |
| 3,159,860 | A | 12/1964 | Colver | |
| 3,319,278 | A | 5/1967 | Frazer | |
| 3,748,679 | A | 7/1973 | Rosendall | |
| 4,263,689 | A | 4/1981 | Leibscher et al. | |
| 5,239,721 | A * | 8/1993 | Zahuranec | 15/41.1 |
| 7,152,267 | B2 * | 12/2006 | Kaleta | 15/42 |
| 7,340,795 | B2 * | 3/2008 | Kaleta | 15/42 |
| 2007/0074358 | A1 * | 4/2007 | Tsai | 15/42 |

FOREIGN PATENT DOCUMENTS

WO 2005/087075 * 9/2005

* cited by examiner

*Primary Examiner*—Mark Spisich
(74) *Attorney, Agent, or Firm*—Knechtel, Demeur & Samlan

(57) ABSTRACT

A light weight floor sweeper has a sweeper head mounted to an elongated handle by means of a universal pivot or universal joint which allows the floor sweeper head to easily pivot about the handle in any direction to pick up debris under over hanging cabinets or under furniture. The floor sweeper has sweeping brushes mounted around all four sides of the sweeper head to provide sweeping action when the sweeper is moved in any direction. There are corner brushes extending out from the sides of the sweeper head that reach into corners to sweep debris toward the main sweeping brushes. All of the brushes are powered by a small electric motor that drives the brushes to direct the debris into a dust-receiving tray in the sweeper head. A gasket arrangement keeps dust and debris out of the gear housings located at each of the corners of the sweeper head regardless of the direction in which the sweeper head is moving.

14 Claims, 5 Drawing Sheets

GASKETS FOR FLOOR SWEEPER

I. BACKGROUND AND SUMMARY OF THE INVENTION

This invention relates to handheld floor sweepers and more particularly to a hand held floor sweeper having a plurality of sweeping brushes powered by an electric motor. The sweeping brushes are located on each side of the sweeper. The floor sweeper has an elongated handle that has a battery pack to supply power to the electric motor that provides the power to rotate the sweeping brushes. This invention is directed to the gaskets that keep hair and debris out of the gear housings mounted at each corner of the sweeper.

Handheld sweepers have been used in the past to pick up dust and small items from hard surfaces, such as wood or tile floors, and carpets having varying piles of various heights. One type of handheld floor sweeper that has been used extensively in the past is a manually pushed floor sweeper that is not powered by a motor. The handheld sweeper has brushes mounted on a shaft located in the sweeper head that contact the surface to be cleaned. The brushes rotate as the sweeper is pushed and pulled across the floor surface. The brushes rotate and the bristles sweep the loose material up into a dust canister or similar dust-receiving portion in the sweeper head. A problem with this type of floor sweeper is that it only picks up material in the forward or rearward direction as the user pushes or pulls the sweeper across the floor as the sweeper is designed for movement in just the forward or reward directions. The sweeper head does not rotate about its handle for movement in the left or right directions, nor does it easily change directions for cleaning under low overhanging objects such as under cabinets or furniture.

The invention disclosed herein is a floor sweeper which is extremely light and has a very low profile sweeper head. The floor sweeper head is mounted to an elongated handle by means of a universal pivot or universal joint. This allows the floor sweeper head to easily pivot about the handle in any direction for easily picking up loose materials under over hanging cabinets or under furniture. There is an electric motor mounted in the sweeper head that drives a plurality of shafts that have brushes mounted thereon on all four sides of the sweeper head. The shafts are drivingly interconnected at corners of the sweeper head by means of gears mounted in gear housings. Felt gaskets are mounted around the shafts in order to keep hair out of the gear housings. There is a rechargeable battery pack mounted on the elongated handle to provide power to the electric motor. Power is provided to the motor from the battery pack through the elongated handle and the universal pivot or universal joint. The brushes provide cleaning action in any direction, not just in the forward or reverse direction. The motor drives the brushes to direct the dust or loose material into the dust-receiving canister in the sweeper head. Furthermore there are brushes extending out from the sides of the sweeper head that reach into corners to sweep debris into the main brushes. All of the brushes are powered by the electric motor.

II. OBJECTS OF THE INVENTION

It is an object of the invention to provide a handheld sweeper that has sweeper brushes in the sweeper head to clean a surface regardless of which direction the sweeper is moved. Another object is to provide a handheld sweeper that has the sweeper brushes mounted on shafts on all four sides of the sweeper head that are mechanically interconnected and driven by a motor. Yet another object is to provide mechanical gear housings at all four corners of the sweeper head to mechanically connect the shafts to adjacent shafts and provide shaft sealing means to restrict the entrance of hair or other debris into the gear housing and to further prevent hair from lodging between the shaft and the gear housing.

III. DESCRIPTION OF THE DRAWINGS

IV. DETAILED DESCRIPTION OF THE PREFERRED EMBODIMENT

Figure 1:
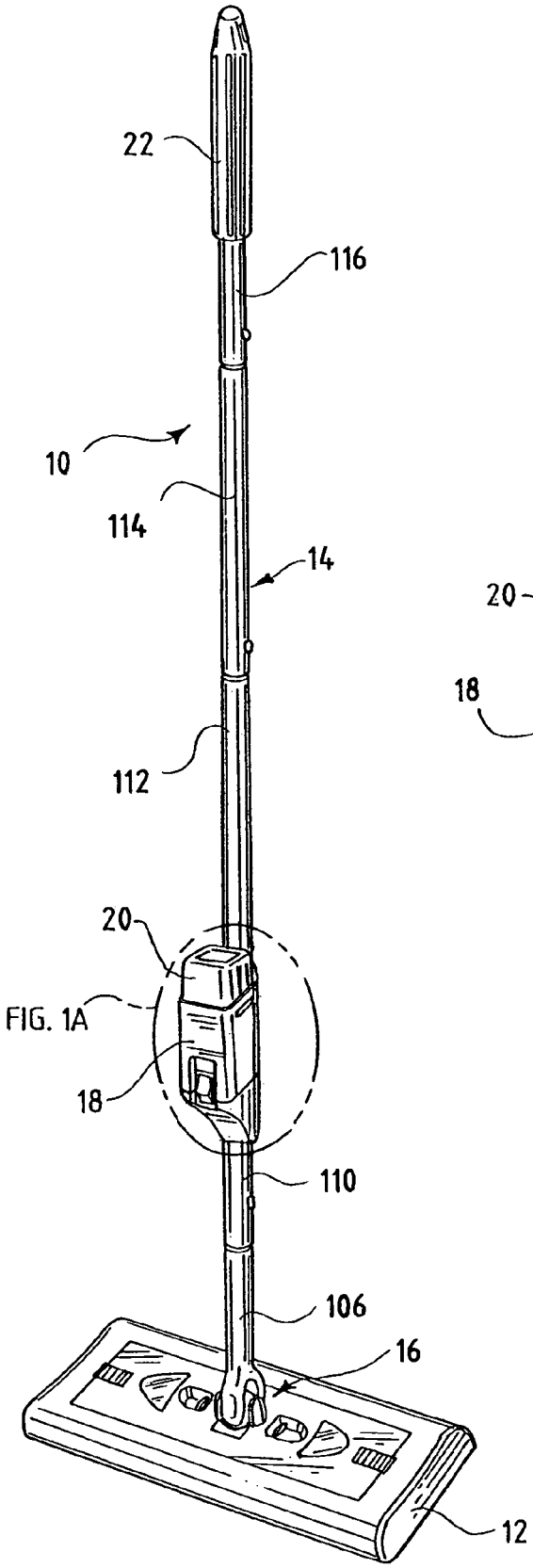
FIG. 1 is a perspective view of the handheld sweeper.
Figure 1A:
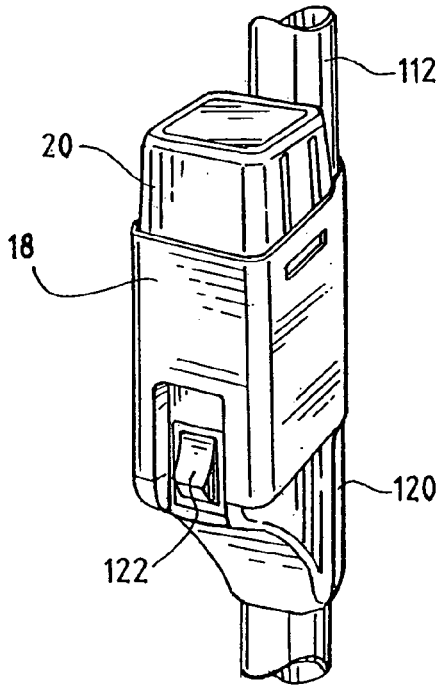
FIG. 1A is an enlarged perspective view of the battery pack shown in the encircled portion on FIG. 1.

Turning first to FIG. 1 a sweeper 10 of the present invention is disclosed. There is a sweeper head 12 connected to an elongated handle 14 by means of a universal pivot 16. Mounted on the elongated handle 14 is a battery box 18 that contains a rechargeable battery 20. At a top end of the elongated handle 14 is a grasping portion 22 which the user holds to push, pull or otherwise move the sweeper 10.

Figure 2:
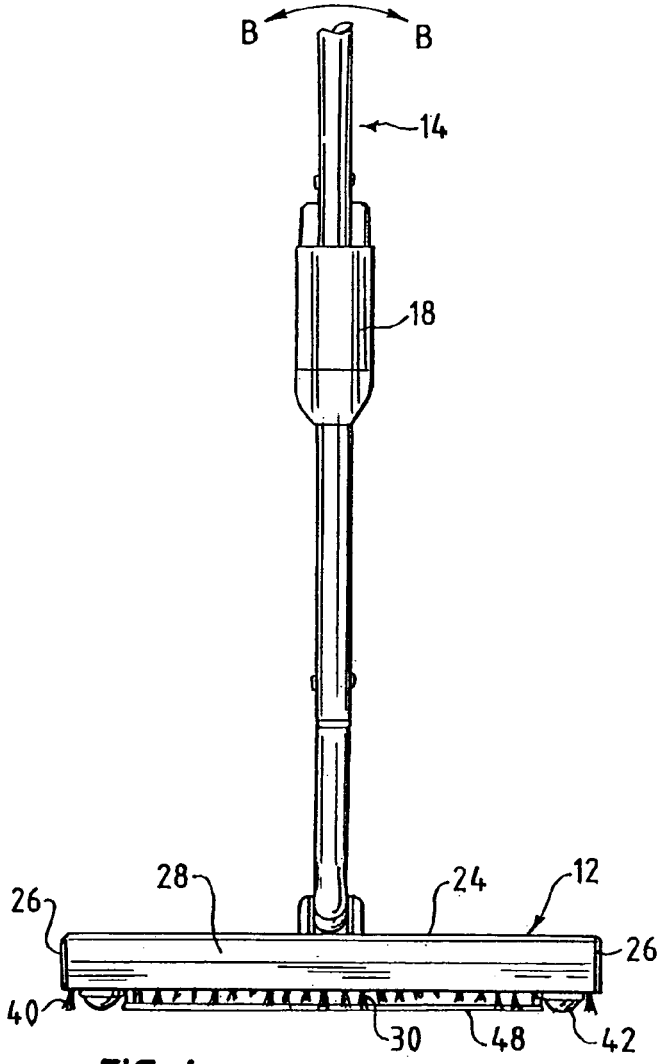
FIG. 2 is a front elevation view with portions removed of the hand sweeper.
Figure 3:
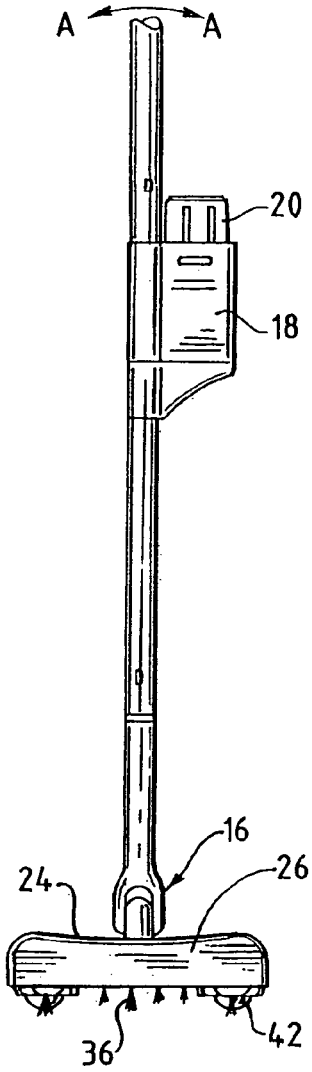
FIG. 3 is a left side view of the sweeper with portions removed.

FIGS. 2 and 3 illustrate the outer design of the sweeper head 12. The sweeper head 12 has a housing comprised of a rectangular top 24, short sides 26 and long sides 28. The universal pivot 16 is attached to the top 24.

Figure 4:
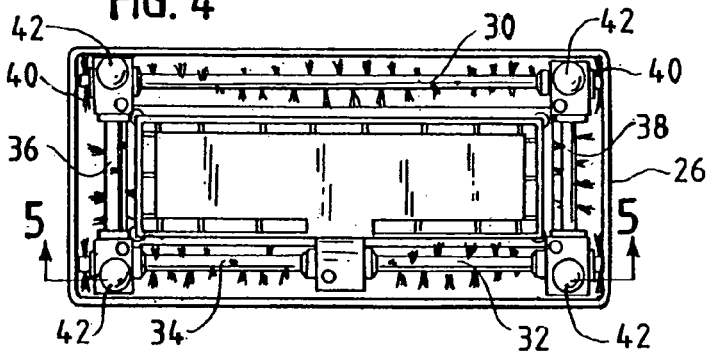
FIG. 4 is a bottom view of the sweeper.

FIG. 4 illustrates the underside of the sweeper head 12. Mounted along one of the long sides 28 at the front of the sweeper head 12 is a long brush 30. Mounted along the other long side 28 at the rear of the sweeper head 12, are a pair of rear brushes 32, 34. Along one of the short sides 26 is a first side brush 36 and along the opposite short side is a second side brush 38. Mounted to or integrally formed in the brushes 30, 32, 34, 36 and 38 are radially extending bristles 39 that are designed to contact the surface to be cleaned and sweep the debris up from the surface.

Corner brushes 40 are mounted with the plane of the bristles substantially parallel to the sides 26 at each of the four corners. However, the bristles of the corner brushes 40 are spread out in the plane parallel to the short side 26 so that the bristles actually extend out beyond the short sides 26. This enables the bristles of the corner brushes 40 to contact and clean a corner formed between the floor and a wall or other upstanding surface. If the bristles do not extend at least under the short sides 26, the short sides 26 contact the wall or other upstanding surface and will not allow the corners to be swept. All of the brushes are mounted on shafts so that the brushes can freely rotate.

The sweeper head 12 slides on high gloss, high polished plastic slides or glides 42 as seen in FIGS. 2-4. These are positioned in each of the four corners of the sweeper head 12 and allow the sweeper head 12 to easily glide over both a hard surface and carpet. Rollers may replace these glides. Furthermore the sweeper head can be easily moved in any direction along the surface to be cleaned, and the arrangement of the rollers along the front, rear and sides result in the sweeping of debris from the surface regardless of the direction of movement.

Figure 6:
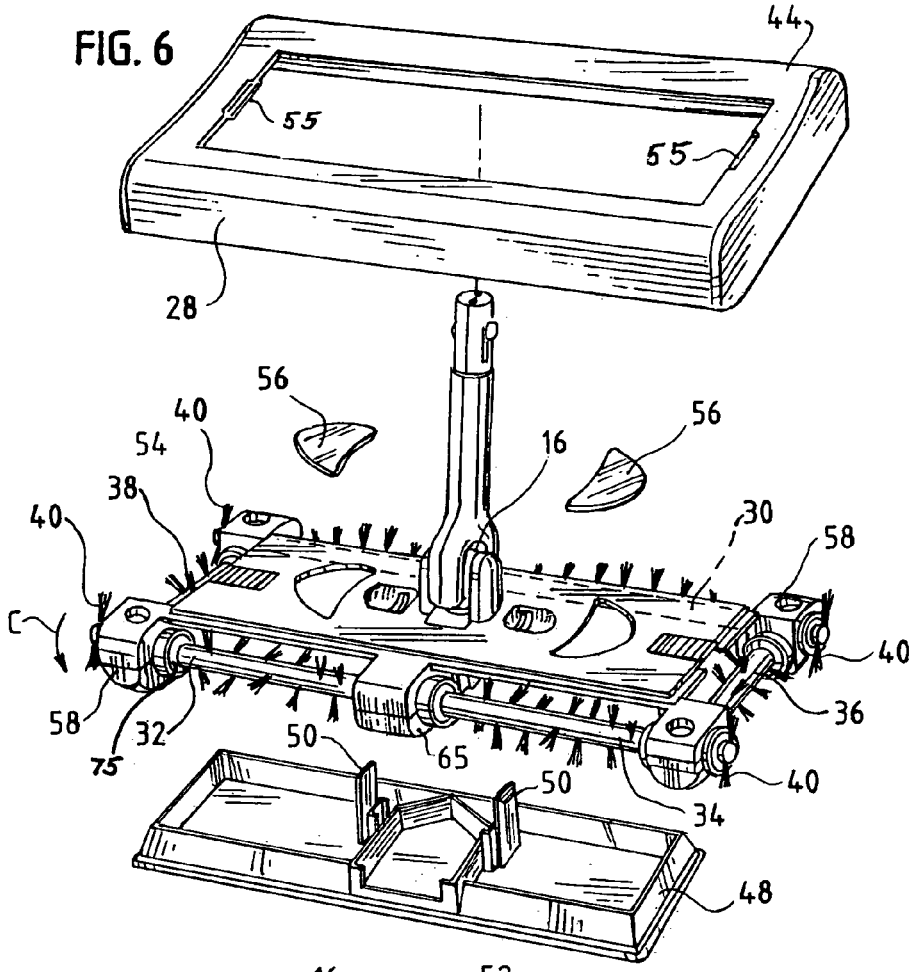
FIG. 6 is a partially exploded view of the sweeper head.
Figure 7:
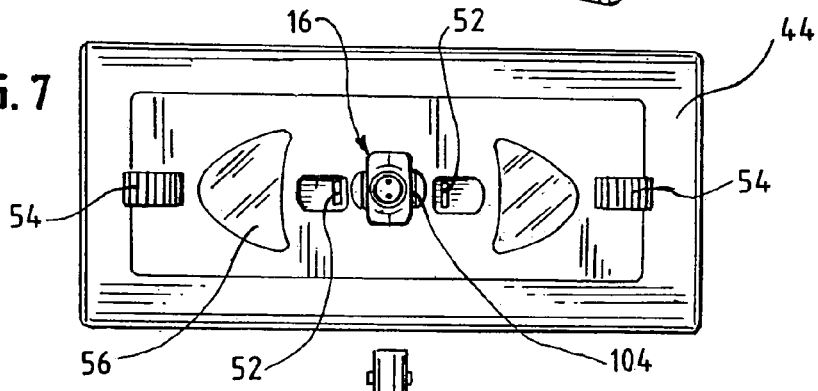
FIG. 7 is a top view of the sweeper head.
Figure 8:
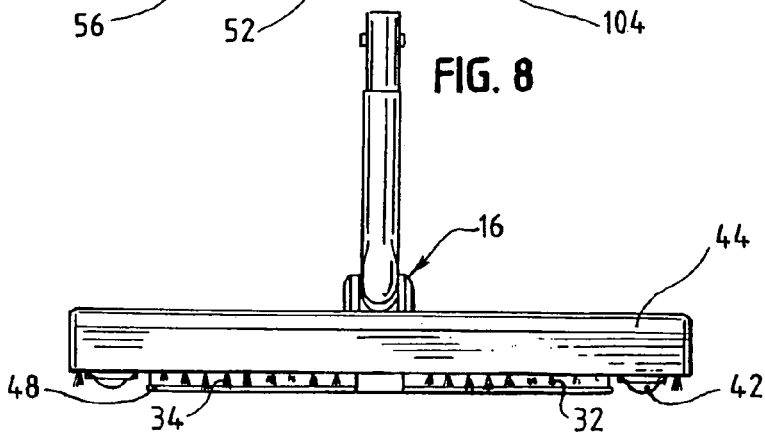
FIG. 8 is a rear view of the sweeper head with the elongated handle removed.

The sweeper head 12 has a top casing 44 as seen in FIG. 6. The brushes are mounted on a chassis 46. The universal pivot 16 is also mounted to the chassis 46. A dust receiving tray 48 is positioned below the chassis 46. Locating and locking tabs 50 extend upwardly from the dust receiving tray 48. These tabs 50 extend through receiving slots 52 in the chassis 46. The slots 52 have locking means to engage and lock the tabs 50 within the slots 52. Sliding tabs 54 on the chassis 46 can slide outward to engage indentations 55 in the top casing 44. In this manner the chassis 46 is placed in locking engagement with the top casing 44. When the dust receiving tray 48 is full and is to be emptied, the tabs 50 are pushed to one side which unlocks them from the slots 52 and the dust receiving tray 48 is released for emptying. Two plastic windows 56 mounted in the top of the chassis 46 allow the user to observe the inside of the dust receiving tray 48 so that it can be emptied when it is full of debris. FIG. 7 illustrates the dust receiving tray 48 and chassis 46 attached to the casing 44.

Figure 9:
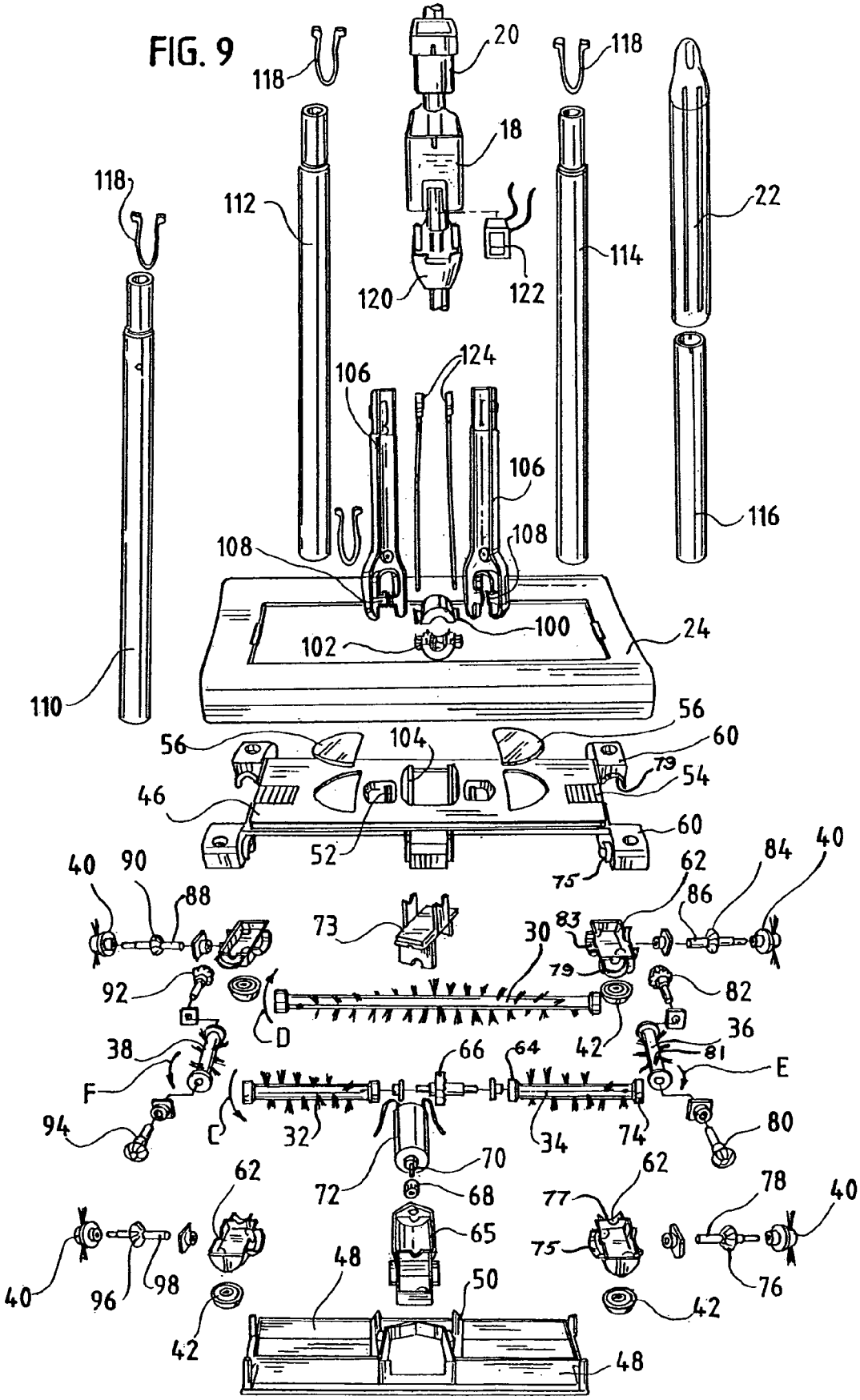
FIG. 9 is a fully exploded view of the sweeper head.

As seen in FIGS. 6 and 9, each of the brushes 30, 32, 34, 36 and 38 is mounted on shafts for rotation. The ends of the brushes are mounted in gear housings 58 comprised of a top housing 60 and a bottom housing 62. There are four identical gear housings 58, one at each of the four corners of the chassis 46. The shafts 34, 36, 30, 38 and 32 are mechanically interconnected as described herein. One end 64 of shaft 34 is mounted in a motor housing 65. Gear 66 is mounted on the one end 64 of shaft 34 and is driven by pinion 68 which, in turn, is mounted on drive shaft 70 of a motor 72. The motor 72 is mounted in the motor housing 65 and supported by a motor bracket 73. Other end 74 of shaft 34 passes through a circular opening 75 in the gear housing 58 and is thus supported by the opening 75 and mounted within the gear housing 58. Bevel gear 76 is mounted on shaft 78 which is connected to other end 74 of shaft 34. Shaft 78 extends out from the gear housing 58 and has a corner brush 40 mounted at its end opposite the other end 74. A complementary bevel gear 80 is mounted on shaft 81 of the first side brush 36, which is an adjacent 90-degree shaft to shaft 34. Shaft 81 also passes through a circular opening 77 in the gear housing 58 and is supported by the opening 77. The other end of the shaft 81 passes through a circular opening 79 in the gear housing 58 as previously described. Similarly bevel gear 82 is mounted at the other end of the shaft 81. Complementary bevel gear 84 mounted on shaft 86 engages bevel gear 82. These gears are located in a second gear housing 58. Shaft 86 is connected to one end of long brush 30 which passes through a circular opening 83 in gear housing 58. In a similar arrangement the other end of long brush 30 has shaft 88 connected to it with bevel gear 90 mounted on it. Complementary bevel gear 92 engages bevel gear 90. These gears are located in a third gear housing. Gear 92 in turn is mounted on one end of the second side brush 38. Bevel gear 94 is mounted on the other end of the second side brush 38. Complementary bevel gear 96 is mounted on shaft 98, which in turn is connected to one end of the rear brush 32. These gears are located in a fourth gear housing. The other end of the rear brush 32 is retained within the motor housing 65. This gear arrangement drivingly interconnects brushes 34, 36, 30, 38 and 32 respectively such that all of the brushes rotate in unison. Although it is only described above for two of the gear housings, all of the gear housings and motor housing 65 have circular openings through which the respective shafts 34, 36, 30, 38 and 32 pass. In an effort to reduce costs, all of the bevel gears are preferably made of plastic material.

Figure 5:
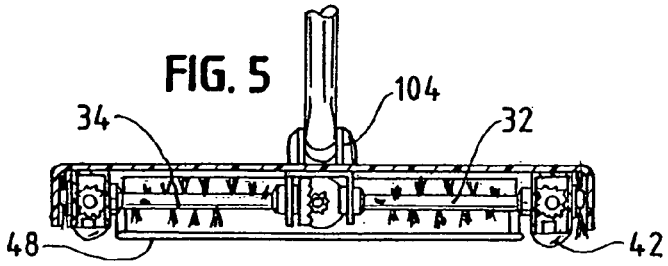
FIG. 5 is a cross sectional view taken along line 5-5 of FIG. 4 showing the sweeper head.

Shafts 78, 86, 88 and 98 have an end that extends out from its respective gear housing 58. Securely mounted on the end of the shaft extending out from the gear housing is a corner brush 40. Thus the corner brushes 40 rotate with the respective rotating long brush or rear brush to which it is connected. The corner brushes spread outward at their tips such that their bristles are under the bottom of the short side 26 of the sweeper head 12. This is seen in FIGS. 2, 4 and 5.

The elongated handle 14 is connected to the sweeper head 12 by means of the universal pivot 16, which is more clearly shown in FIG. 6. The universal pivot connection allows the handle 14 to swivel from the front to the back and from side to side with respect to the sweeper head 12. This allows the sweeper head to easily rotate in any direction to easily move under furniture, ledges, shelves, etc. The universal pivot 16 is comprised of several components as seen in FIG. 9. There is a pivot ball top 100 and a pivot ball bottom 102 supported by a pivot ball support 104. There are two cross arm yokes 106, which receive the pivot ball top 100 and bottom 102 between the two yokes 106. The pivot ball top and bottom allow the cross arm yokes 106 to rotate on the pivot ball support 104 from one long side 28 to the opposite long side 28. This allows the elongated handle 14 to pivot about the sweeper head 12 as seen by the arrow A-A in FIG. 3.

The yokes 106 have pins 108 at their bottom ends that are rotatably received in the pivot ball top 100 and bottom 102. This provides a pivot point about which the handle 14 can rotate about the sweeper head 12 from one short side 26 to the other short side 26 as illustrated by the arrow B-B of FIG. 2. Other types of universal pivot connections can be utilized as will be apparent to those skilled in the art of mechanical pivot connections. The important point is to allow the handle 14 to freely rotate in all directions about the sweeper head 12.

The elongated handle l4 is assembled from a series of interlocking pipes or tubes 110, 112, 114 and 116. Spring loaded pins or locks 118 are placed in one end of each of the tubes 110, 112, and 114, which interlock with receiving holes in the next adjacent tube. One end of each of tubes 110, 112, and 114 has a reduced diameter to receive the end of the next tube above it so that the tube slides over the reduced diameter end.

The rechargeable battery 20 is also mounted on the elongated handle 14 in the battery box 18. The battery box 18 has a removable base 120, which allows access to a switch 122. The switch 122 turns the motor 72 on and off. Electrical wires 124 connect the motor 72 to the battery 20.

The motor 72 and gear drive mechanism cause each of the brushes to rotate in a direction such that the dust or loose material is swept into the sweeper head 12 where it is received in the dust receiving tray 48. For example, as seen in FIG. 9, rear brushes 32 and 34 rotate in the direction of arrow C. Long brush 30 rotates in the opposite direction as illustrated by arrow D. This enables the sweeper 10 to pick up dust or debris when pushed or pulled in either a forward or backward direction.

The first side brush 36 rotates in direction of arrow E and the second side brush 38 rotates in the opposite direction of arrow F. In this manner the side brushes brush debris in a direction under the sweeper head so that it can be swept into the receiving tray 46. Each of the corner brushes 40 are connected to and driven in the same direction as brushes 30, 32, and 34. As the brushes 40 are mounted at the outer perimeter of the gear housing 58 and under the short sides 26 of the sweeper head top 24, the corner brushes 40 can reach into tight corners and sweep the debris or dust out of the corners where it is directed into one of the first or second side brush 36 or 38. Then the debris is swept by one of the side brushes into the dust-receiving tray 48. In this manner the corner brushes always sweep the debris toward the center of the side brushes where it is swept into the receiving tray 48.

The overall height of the sweeper head 12 including the brushes and glides 42 is maintained as a very low profile sweeper to allow the sweeper to get under cabinets, chairs and low overhangs. The universal pivot 16 allows the sweeper head to easily rotate in any direction for ease in reaching tight spots and permits cleaning the entire floor surface. The battery 20 can be a conventional rechargeable battery that is recharged by plugging into a battery charger. The motor and battery are selected to provide adequate power to the brushes for enough time to perform a normal cleaning operation. All of the components can be easily and inexpensively manufactured from plastic or metal. Thus the weight of the sweeper 10 can thus be kept at a minimum for ease of maneuvering. Due to the light weight of the sweeper 10, the universal pivot and the glides 42, the sweeper head 12 can be very easily moved in any direction. The brush arrangement of having brushes on all sides allows the sweeper head 12 to pick up debris when the sweeper head 12 is moved in any direction. This causes a new problem that is not found when the sweeper only picks up debris when moved forward and back. When the sweeper head is moved side to side, debris, comprised of mainly hair, is forced along the shafts toward the gear housings 58 and motor housing 65. In prior designs, the hair works its way through the circular openings 75, 77, 79, and 83 into the gear housings and the motor housing. The hair wraps around the bevel gears and their respective shafts inside of the gear housings 58 and motor housing 65. This causes the gears to seize or, if they are made of plastic, the friction of the hair and gears causes the gears to heat up and melt.

Figure 10:
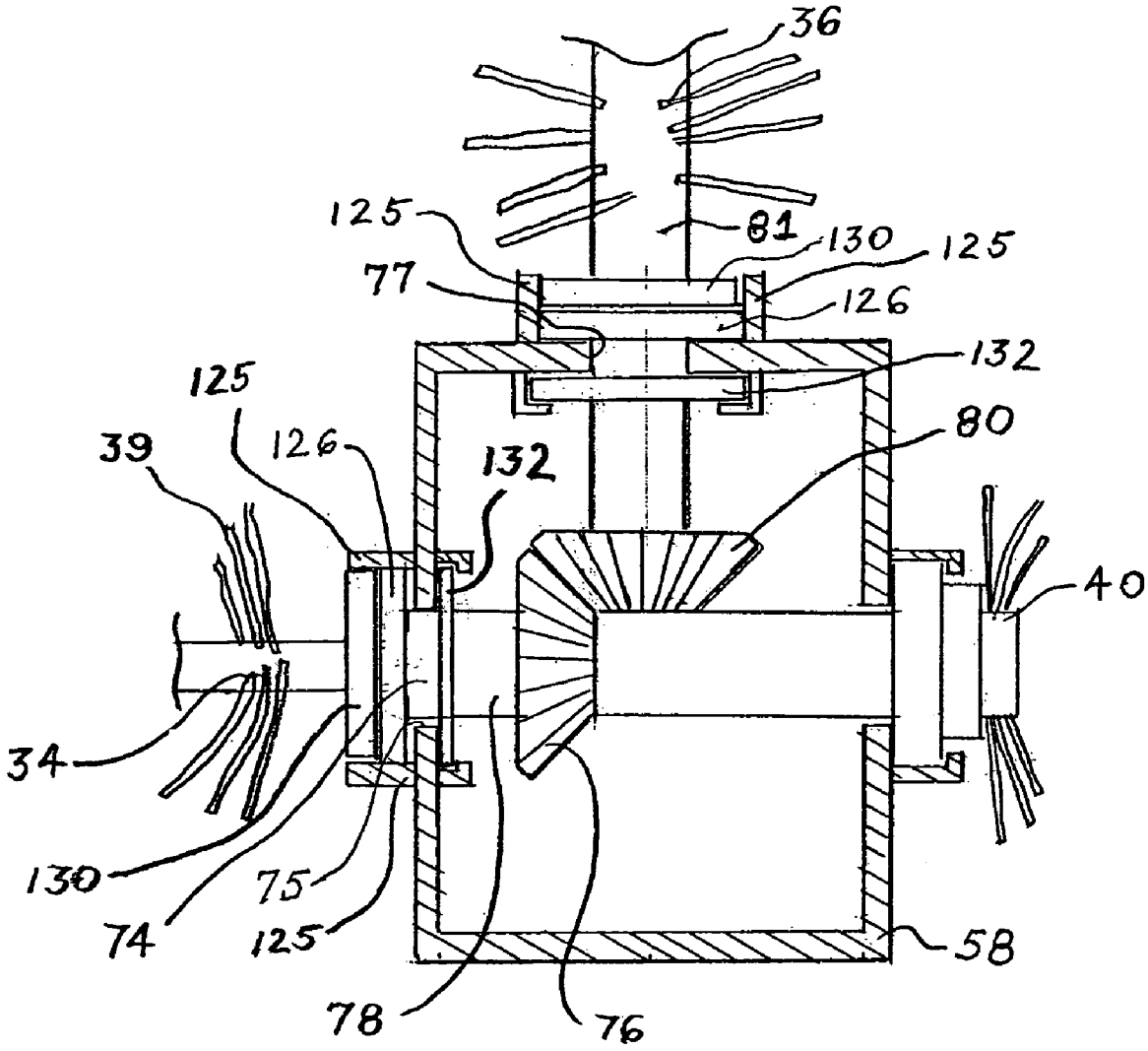
FIG. 10 is an enlarged view in cross section with portions removed of the gear housing at each corner of the sweeper illustrating the internal gears and the gasket to keep debris out of the gear housing.
Figure 11:
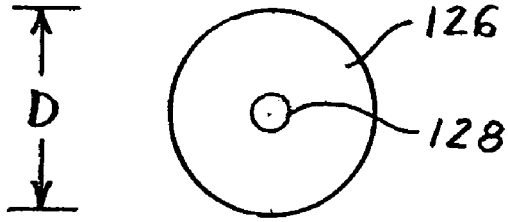
FIG. 11 is a view of the gasket taken along line 11-11 of FIG. 10.

To solve this problem, applicant added a new gasket design to all of the gear housings 58 and the motor housing 65. The gasket design is more clearly illustrated in FIGS. 10 and 11. The gear housing 58 has the opening 75 formed along one side of the gear housing 58. A circular collar 125 extends from the wall of the gear housing 58. There is a gasket 126 formed as a ring or washer that has a central opening 128 that slides over the brush 34 and fits inside of the circular collar 125. The central opening 128 has a diameter slightly less than the brush 34 so that the gasket 126 rotates with the rotation of the brush 34. The gasket 126 is preferably made of felt and has a thickness of approximately 2.7 mm. Alternatively the gasket 126 can be made of any soft, cloth like material or can be made of open celled material such as Styrofoam. The gasket 126 has an outside diameter D which is slightly greater than the diameter of the circular collar 125 so that the gasket 126 rubs lightly against the circular collar 125 and provides a seal against the opening 75 to keep dirt, debris and hair out of the gear housing 58. The gasket 126 actually rotates slightly slower than the shaft 34 due to the frictional engagement of the gasket 126 with the circular collar 125. There is a locking end ring 130 also on the bush 34 to secure the gasket 126 between the end ring 130 and the gear housing 58. This keeps the gasket 126 within the circular collar 125 at all times so that the opening 75 is always protected from the entrance of dirt and debris. The locking end ring 130 can be secured to the brush 34 by means of a groove cut into the brush 34 with a locking rim on the end ring 130 that securely engages and rests within the groove. Alternatively the locking end ring 130 can be glued, welded or otherwise firmly secured to the brush 34. Furthermore there is a positioning ring 132 located on the shaft 78 to keep the brush 34 securely positioned within the gear housing 58.

Brush 36 has a similar design. On shaft 81 there is a locking end ring 130 that secures the gasket 126 between the end ring 130 and the gear housing 58. This keeps the gasket 126 within the circular collar 125 and protects the opening 77 from the entrance of dirt and debris. A positioning ring 132 is mounted on shaft 81 within the housing 58 that securely positions and retains the shaft 81 within the housing 58. The same gasket design is provided for all of the gear housings 58 and the motor housing 65.

Thus there has been provided a gasket system for a floor sweeper that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A floor sweeper comprising:

an elongated handle having opposite top and bottom ends;

a substantially rectangular sweeper head mounted at the bottom of the elongated handle, the sweeper head having a front, back, and opposite first and second sides, a front roller shaft having opposite ends mounted on the front for rotation in a first direction;

a rear roller shaft having opposite ends mounted on the back for rotation in a second direction opposite the first direction;

first and second side roller shafts having opposite ends mounted on the first and second sides respectively;

the front, rear and side roller shafts all having sweeping bristles mounted thereon;

first gear housing mounted at one of the corners of the rectangular sweeper head, the front roller shaft and the first side roller shaft having an end mounted in the first gear housing, the front roller shaft and the side roller shaft drivingly connected to each other;

a first circular opening in the first gear housing through which the front roller shaft passes;

a circular collar extending from the first gear housing and disposed about the first circular opening;

a cylindrical flexible soft gasket mounted on the front roller shaft adjacent to the first circular opening for restricting the entrance of debris through the first opening into the first gear housing, the diameter of the flexible soft gasket being at least as great as the diameter of the first circular opening;

a first gasket retaining ring mounted on the front roller shaft adjacent to the gasket for retaining the gasket between the first circular opening and the first gasket retaining ring, the first flexible soft gasket and first gasket retaining ring fitting inside of the circular collar;

a second circular opening in the first gear housing through which the first side roller passes;

a second circular collar extending from the first gear housing and disposed about the second circular opening:

a second cylindrical flexible soft gasket mounted on the first side roller shaft adjacent to the second circular opening for restricting the entrance of debris through the second opening into the gear housing, the diameter of the second flexible soft gasket being at least as great as the diameter of the second circular opening, a second gasket retaining ring mounted on the first side roller shaft adjacent to the second gasket for retaining the second gasket between the second circular opening and the second gasket retaining ring, the second flexible soft gasket and second gasket retaining ring fitting inside of the second circular collar;

a positioning ring operatively connected to each of the front roller shaft and the first side roller shaft within the first gear housing adjacent to the first circular opening and second circular opening respectively through which the front roller shaft and first side roller shaft passes; and an inner wall of the housing including a means to retain the respective positioning ring, the retaining means including a wall portion spaced from the respective opening which limits axial movement of the positioning ring.

2. The floor sweeper of claim 1 and further comprising:

a second gear housing mounted at a second corner of the rectangular sweeper head, the front roller shaft and the second side roller shaft having an end mounted in the second gear housing, the front roller shaft and the second side roller shaft drivingly connected to each other;

a first circular opening in the second gear housing through which the front roller shaft passes;

a cylindrical flexible soft gasket mounted on the front roller shaft adjacent to the first circular opening for restricting the entrance of debris through the first opening into the second gear housing, the diameter of the flexible soft gasket being at least as great as the diameter of the first circular opening;

a second circular opening in the gear housing through which the second side roller passes; and a second cylindrical flexible soft gasket mounted on the second side roller shaft adjacent to the second circular opening for restricting the entrance of debris through the second opening into the second gear housing, the diameter of the second flexible soft gasket being at least as great as the diameter of the second circular opening.

3. The floor sweeper of claim 2 and further comprising:

a third gear housing mounted at a third corner of the rectangular sweeper head, the rear roller shaft and the first side roller shaft having an end mounted in the third gear housing, the rear roller shaft and the first side roller shaft drivingly connected to each other;

a first circular opening in the third gear housing through which the rear roller shaft passes;

a cylindrical flexible soft gasket mounted on the rear roller shaft adjacent to the first circular opening for restricting the entrance of debris through the first opening into the third gear housing, the diameter of the flexible soft gasket being at least as great as the diameter of the first circular opening;

a second circular opening in the gear housing through which the first side roller passes; and a second cylindrical flexible soft gasket mounted on the first side roller shaft adjacent to the second circular opening for restricting the entrance of debris through the second opening into the third gear housing, the diameter of the second flexible soft gasket being at least as great as the diameter of the second circular opening.

4. The floor sweeper of claim 3 and further comprising:

a fourth gear housing mounted at a fourth corner of the rectangular sweeper head, the rear roller shaft and the second side roller shaft having an end mounted in the fourth gear housing, the rear roller shaft and the second side roller shaft drivingly connected to each other;

a first circular opening in the fourth gear housing through which the rear roller shaft passes;

a cylindrical flexible soft gasket mounted on the rear roller shaft adjacent to the first circular opening for restricting the entrance of debris through the first opening into the fourth gear housing, the diameter of the flexible soft gasket being at least as great as the diameter of the first circular opening;

a second circular opening in the gear housing through which the second side roller passes; and a second cylindrical flexible soft gasket mounted on the second side roller shaft adjacent to the second circular opening for restricting the entrance of debris through the second opening into the fourth gear housing, the diameter of the second flexible soft gasket being at least as great as the diameter of the second circular opening.

5. The floor sweeper of claim 4 wherein the gaskets are made of felt.

6. The floor sweeper of claim 1 wherein the gaskets are made of felt.

7. A floor sweeper for sweeping a surface comprising:

a sweeper head of substantially rectangular configuration having a top and bottom, a front side, a rear side, and first and second opposite sides, the first and second sides intersecting the front side and defining two front corners at the line of intersection, the first and second sides further intersecting the rear side and defining two rear corners at the line of intersection;

a front roller mounted at the front side;

a rear roller mounted at the rear side;

a first side roller mounted at the first side;

a second side roller mounted at the second side;

the front roller, rear roller, first and second side rollers all having sweeping bristles thereon;

debris receiving means mounted on the sweeper head for receiving debris swept by the bristles;

a gear housing at each corner for mechanically connecting the front roller, rear roller, first side roller and second side roller to each other;

each gear housing having a first and second opening through which a roller passes;

a circular collar extending from the housing and respectively disposed about each of the circular openings;

flexible soft gasket means mounted on each roller adjacent to the opening through which the roller passes, the diameter of the flexible soft gasket means being at least as large as the opening for restricting the entrance of debris through the opening, a gasket retaining ring mounted on each roller adjacent to each flexible soft gasket means for retaining the flexible soft gasket means between the opening through which the roller passes and its respective gasket retaining ring, each gasket and retaining ring fitting inside of the respective collar;

a positioning ring operatively connected to each roller within the housing adjacent the circular opening through which the roller passes; and an inner wall of the housing including a means to retain the respective positioning ring, the retaining means including a wall portion spaced from the respective opening which limits axial movement of the positioning ring.

8. The floor sweeper of claim 7 wherein the flexible soft gasket means is made of felt.

9. The floor sweeper of claim 7 wherein the openings are cylindrical and wherein the flexible soft gasket means is cylindrical with a central opening that receives the roller on which it is mounted, the diameter of the flexible soft gasket means being substantially the same as the diameter of the openings for restricting the entrance of debris through the openings.

10. A floor sweeper adapted to be moved over a surface and clean the surface by brushing the sweeper comprising:

a head having a plurality of brushes rotatably mounted thereon extending below the head for engaging the surface, the brushes mounted to rotate in a direction such as to sweep debris into the head, the first of said brushes facing outwardly from said head in a first direction and the second of said brushes facing outwardly from said head in a second direction different from but not opposite to said first direction, the brushes defining an angle there between having a vertex, moving means operatively connected to said brushes for causing them to rotate relative to said head, coupling means for operatively connecting the brushes together for causing them to rotate together, a housing in which the coupling means are mounted, two circular openings in the housing through which the brushes pass, a circular collar extending from the housing and respectively disposed about each of the circular openings, flexible soft gasket means mounted on each of the brushes adjacent to the circular opening through which the brush passes for restricting dust and debris from entering the housing, a gasket retaining ring mounted on each brush adjacent to each flexible soft gasket means for retaining the flexible soft gasket means between the opening through which the brush passes and its respective gasket retaining ring, each gasket and retaining ring fitting inside the respective collar, a positioning ring operatively connected to each brush within the housing adjacent the circular opening through which the brush passes, an inner wall of the housing including a means to retain the respective positioning ring, the retaining means including a wall portion spaced from the respective opening which limits axial movement of the positioning ring.

11. The floor sweeper of claim 10 wherein the diameter of the flexible soft gasket means has a diameter at least as large as the circular opening for covering the circular opening and restricting the entrance of dirt and debris into the housing.

12. The floor sweeper of claim 11 and further comprising a third brush facing outwardly from said head in a direction opposite to the first direction, the third brush defining an angle between it and the second brush, second coupling means for operatively connecting the third brush to the second brush for causing them to rotate together, a second housing in which the second coupling means are mounted, two circular openings in the second housing through which the second and third brushes pass, flexible soft gasket means mounted on each of the second and third brushes adjacent to the circular opening through which the second and third brushes pass for restricting dust and debris from entering the second housing.

13. The floor sweeper of claim 12 and further comprising a fourth brush facing outwardly from said head in a direction opposite to the second direction, the fourth brush defining an angle between it and the third brush, third coupling means for operatively connecting the fourth brush to the third brush for causing them to rotate together, a third housing in which the third coupling means are mounted, two circular openings in the third housing through which the third and fourth brushes pass, flexible soft gasket means mounted on each of the third and fourth brushes adjacent to the circular opening through which the third and fourth brushes pass for restricting dust and debris from entering the third housing.

14. The floor sweeper of claim 13 and further comprising a fourth coupling means for operatively connecting the fourth brush to the first brush for causing them to rotate together, a fourth housing in which the fourth coupling means are mounted, two circular openings in the fourth housing through which the fourth and first brushes pass, flexible soft gasket means mounted on each of the fourth and first brushes adjacent to the circular opening through which the fourth and first brushes pass for restricting dust and debris from entering the fourth housing.

* * * * *